US006994065B2

(12) United States Patent
Uchiyama et al.

(10) Patent No.: US 6,994,065 B2
(45) Date of Patent: Feb. 7, 2006

(54) INTAKE ARRANGEMENT FOR INTERNAL COMBUSTION ENGINE

(75) Inventors: Shigeki Uchiyama, Yokohama (JP); Kenichi Sakuraba, Kanagawa (JP); Koji Yamashita, Kanagawa (JP); Katsuyuki Nakamura, Yokohama (JP); Toshiya Arai, Yokohama (JP); Ikuhiro Imai, Kanagawa (JP); Isao Yasuma, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/959,583

(22) Filed: Oct. 7, 2004

(65) Prior Publication Data

US 2005/0076873 A1 Apr. 14, 2005

(30) Foreign Application Priority Data

Oct. 10, 2003 (JP) ..... 2003-351584
Oct. 10, 2003 (JP) ..... 2003-351585

(51) Int. Cl.
*F02M 55/00* (2006.01)

(52) U.S. Cl. ..... 123/184.21; 123/184.38

(58) Field of Classification Search ..... 123/184.21, 123/184.38, 184.47, 184.53
See application file for complete search history.

(56) References Cited

U.S. PATENT DOCUMENTS 3,211,139 A * 10/1965 Weber ..... 123/445
4,776,313 A * 10/1988 Freismuth et al. ..... 123/470
5,275,135 A * 1/1994 Clemens et al. ..... 123/184.21
5,809,961 A * 9/1998 Morota et al. ..... 123/184.53
6,604,500 B2 8/2003 Miyahara et al.

FOREIGN PATENT DOCUMENTS

JP 8-334069 A 12/1996
JP 2000-161163 A 6/2000
JP 2002-138913 A 5/2002

OTHER PUBLICATIONS

U.S. Appl. No. 10/959,579, Uchiyama et al., filed Oct. 7, 2004.

* cited by examiner

*Primary Examiner*—Mahmoud Gimie
(74) *Attorney, Agent, or Firm*—Foley & Lardner LLP

(57) ABSTRACT

An intake arrangement for an internal combustion engine, including an intake manifold including an intake collector and a plurality of branch pipes connected with the intake collector. The branch pipes extend in substantially same direction. The intake collector includes an inlet opening through which an intake air flow is introduced into the intake collector, and branch openings to which branch pipes are connected. The branch openings are arranged along a longitudinal direction of the intake collector such that as a distance thereof from the inlet opening decreases, an amount of offset thereof from a reference streamline of the intake air flow extending through substantially a center of the inlet opening along the longitudinal direction of the intake collector increases.

20 Claims, 14 Drawing Sheets

INTAKE ARRANGEMENT FOR INTERNAL COMBUSTION ENGINE

BACKGROUND OF THE INVENTION

The present invention relates to an intake arrangement for an internal combustion engine, and more specifically to an intake arrangement for a multi-cylinder internal combustion engine having a plurality of engine cylinders.

In the multi-cylinder internal combustion engine, as lengths of intake air passages extending to the engine cylinders become more equalized to one another, undesirable dispersion or change in intake volumetric efficiency between engine cylinders is more reduced. This can improve engine output and suppress vibrations of the engine. In addition, waveform, namely, wave amplitude and phase, of induction noise caused by intake air that is introduced into the engine cylinders via the intake air passages, can be rendered uniform by the equalized intake air passages to thereby produce clear engine sound. Thus, it is desirable to equalize the lengths of the intake air passages in an intake arrangement for the internal combustion engine.

Japanese Patent Application First Publication No. 2000-161163 discloses an intake manifold including a surge tank, an intake pipe connected to one side wall of the surge tank, and branch pipes connected to an opposite side wall of the surge tank. The branch pipes are independently coupled to the corresponding engine cylinders. A distance from the connection of the surge tank and the intake pipe, to the connection of the surge tank and each of the branch pipes is substantially the same. Specifically, the connection of the intake pipe with the surge tank is located at a generally middle position in the longitudinal direction of the surge tank. The connection of the outside branch pipes disposed on the opposite sides in the longitudinal direction of the surge tank, with the surge tank is offset from the connection of the inside branch pipes disposed between the outside ones, with the surge tank, in a lateral direction perpendicular to the longitudinal direction of the surge tank.

Japanese Patent Application First Publication No. 8-334069 discloses an intake arrangement including an intake collector, a throttle chamber connected to one longitudinal end portion of the intake collector, and a plurality of branch pipes each having one end coupled to a side wall of the intake collector and the other end coupled to the corresponding engine cylinder.

SUMMARY OF THE INVENTION

In Japanese Patent Application First Publication No. 2000-161163, a width of the surge tank in the lateral direction is increased because of the offset arrangement of the connection of the branch pipes with the surge tank. This will cause deterioration in installability of the intake manifold.

In Japanese Patent Application First Publication No. 8-334069, the distances between the connections of the respective branch pipes with the intake collector, and the connection of the intake collector with the throttle chamber are different from one another. In other words, the distances between branch openings of the intake collector to which the branch pipes are connected, and an inlet opening of the intake collector to which the throttle chamber is connected, are different from one another. Therefore, it is difficult to equalize the lengths of the intake air passages extending from the throttle chamber to the engine cylinders.

It is an object of the present invention to provide an intake arrangement for an internal combustion engine, which can reduce a difference between substantial intake air passage lengths extending to the respective engine cylinders, and thereby improve induction noise generation in the intake arrangement.

In one aspect of the present invention, there is provided an intake arrangement for an internal combustion engine, comprising:

- an intake manifold including an intake collector and a plurality of branch pipes connected with the intake collector,
- the intake collector including an inlet opening through which an intake air flow is introduced into the intake collector, and a plurality of branch openings,
- the plurality of branch pipes being connected to the branch openings of the intake collector, the plurality of branch pipes extending in substantially same direction,
- the plurality of branch openings being arranged along a longitudinal direction of the intake collector such that as a distance thereof from the inlet opening decreases, an amount of offset thereof from a reference streamline of the intake air flow extending through substantially a center of the inlet opening along the longitudinal direction of the intake collector increases.

In a further aspect of the present invention, there is provided an intake arrangement for an internal combustion engine, comprising:

- an intake collector;
- a plurality of branch pipes;
- first means for permitting an intake air flow to be introduced into the intake collector; and
- second means for permitting the intake air flow introduced into the intake collector to flow from the intake collector into the plurality of branch pipes,
- the second means being arranged along a longitudinal direction of the intake collector such that as a distance thereof from the first means decreases, an amount of offset thereof from a reference streamline of the intake air flow extending through substantially a center of the first means along the longitudinal direction of the intake collector increases.

DETAILED DESCRIPTION OF THE INVENTION

In the followings, embodiments of the present invention will be described with reference to the accompanying drawings. For ease of understanding, various directional terms, such as right, left, upper, lower, upward, downward and the like will be used in the following descriptions. Such terms are to be understood with respect to only drawing or drawings in which the corresponding part is illustrated.

Figure 1:
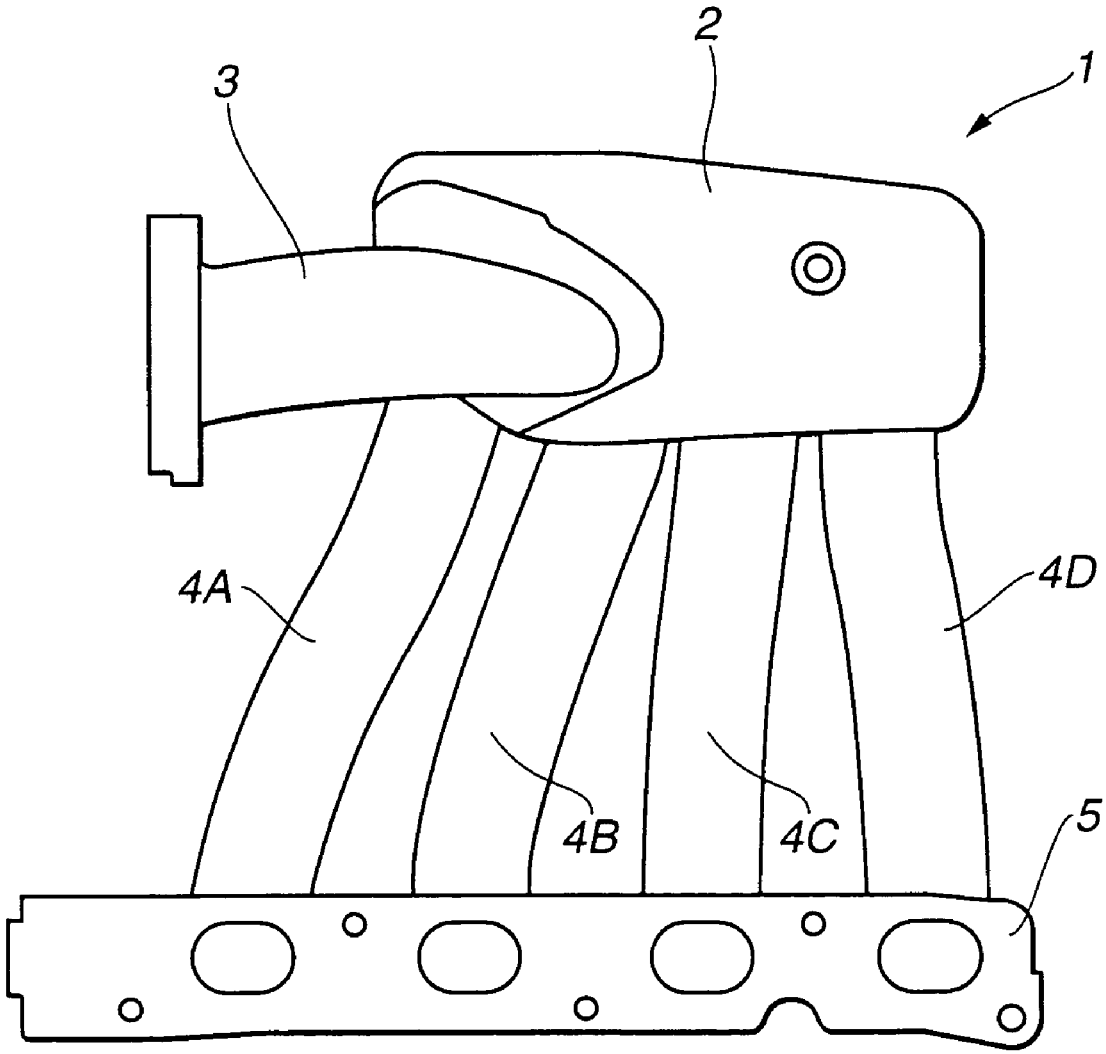
FIG. 1 is a front view of an intake arrangement of a first embodiment according to the present invention.
Figure 2:
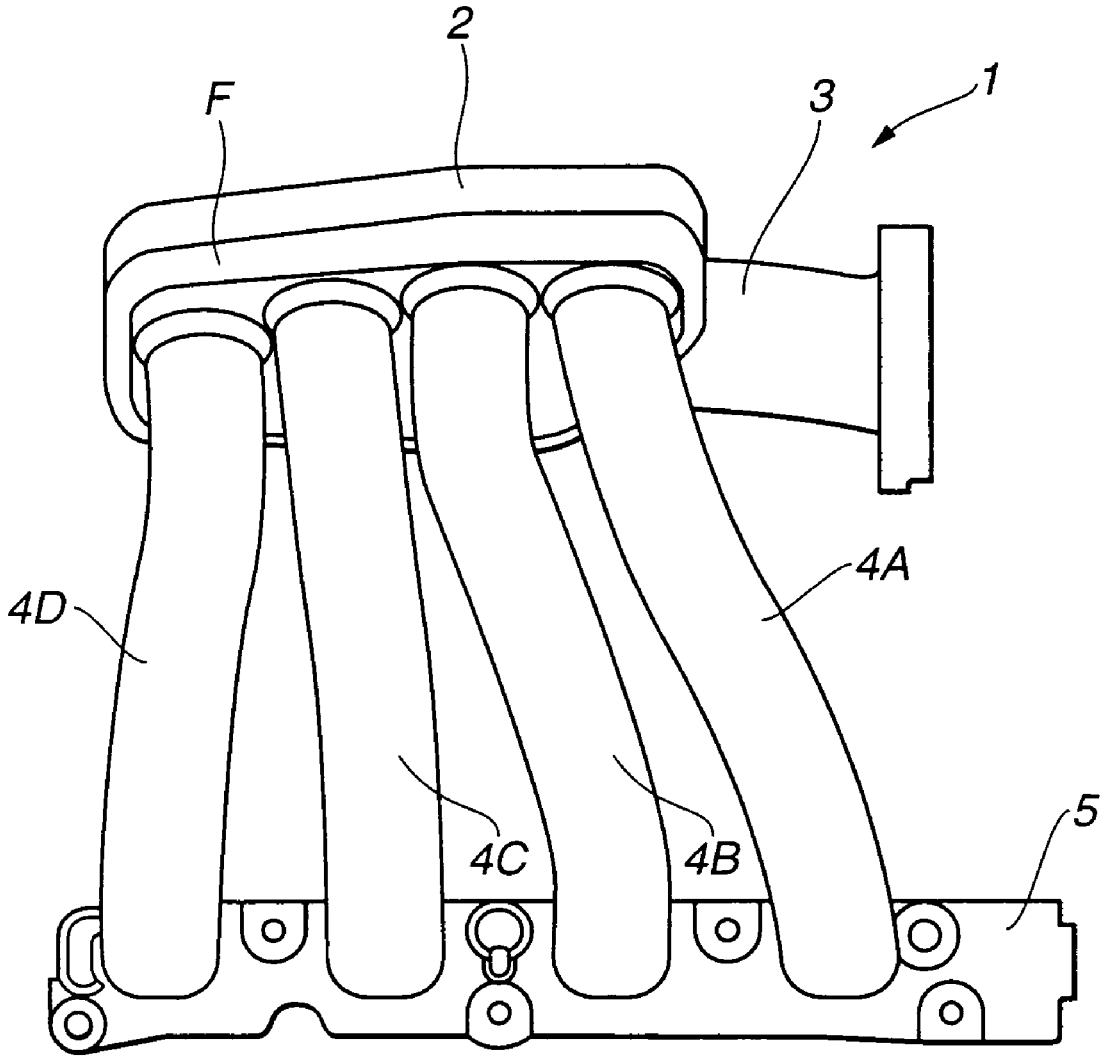
FIG. 2 is a rear view of the intake arrangement of the first embodiment.
Figure 3:
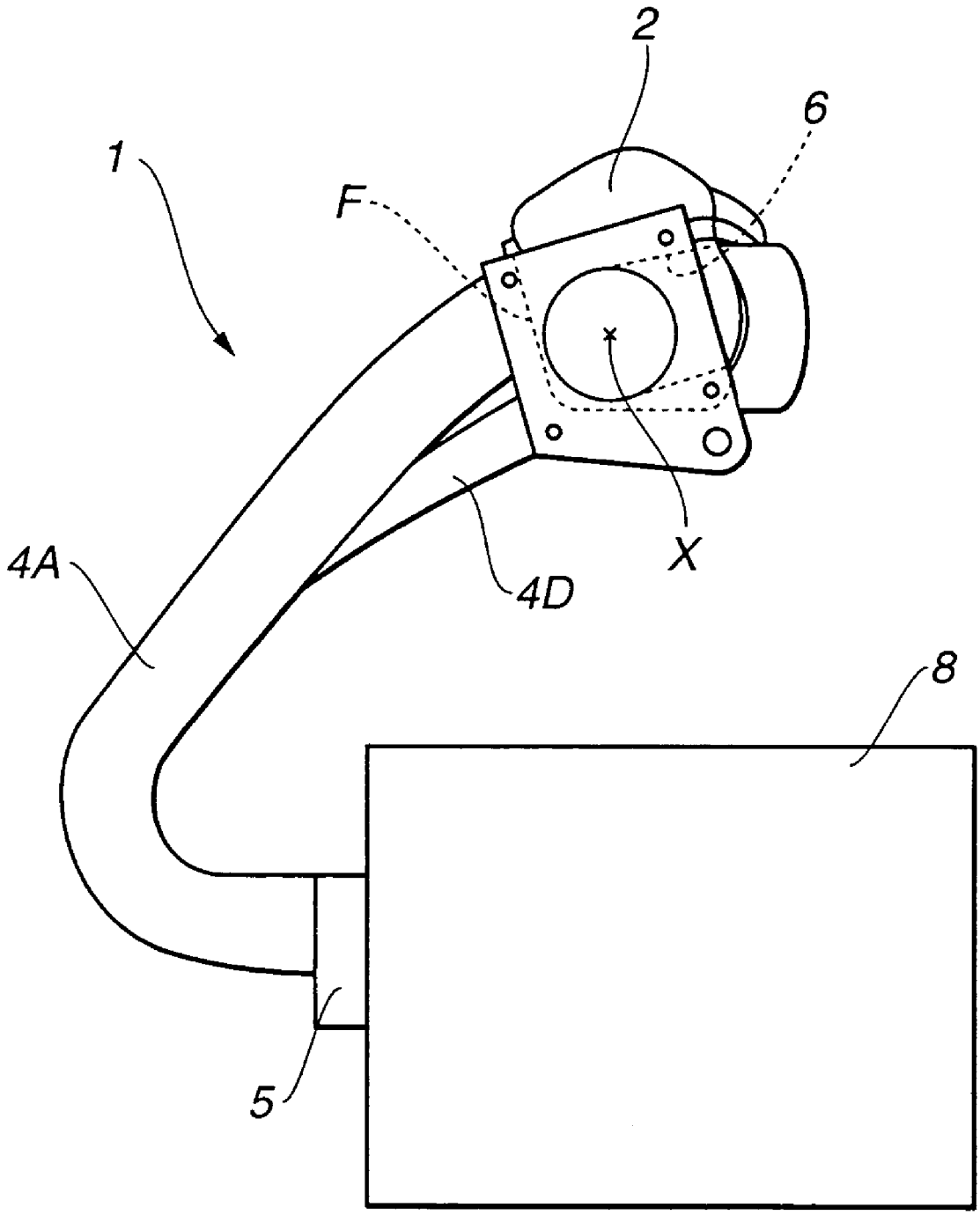
FIG. 3 is a side view of the intake arrangement of the first embodiment as viewed from a left side thereof.
Figure 4A:
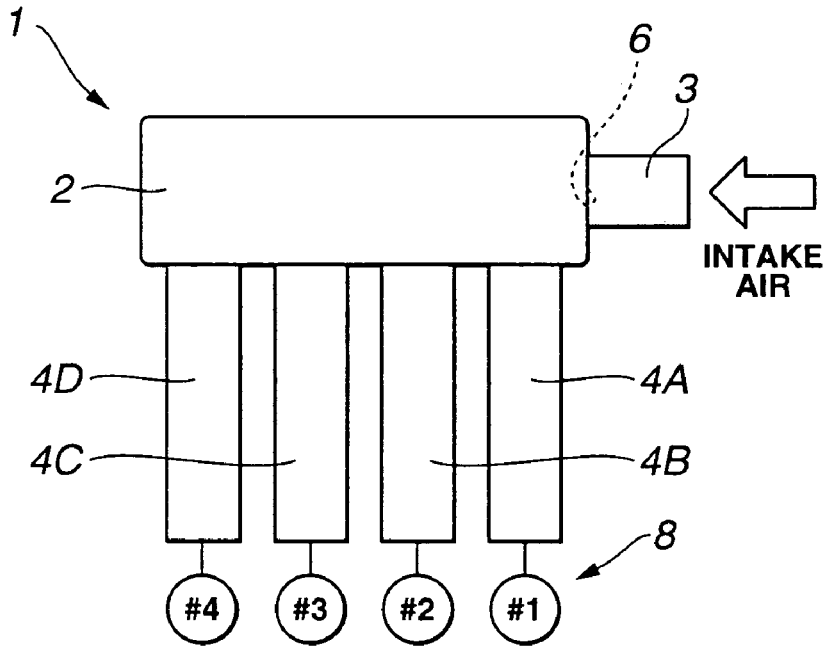
FIGS. 4A–4B are explanatory diagrams schematically showing the intake arrangement of the first embodiment.

Referring to FIGS. 1–3, 4A and 4B, an intake arrangement of a first embodiment of the present invention is explained. In this embodiment, the intake arrangement is applied to an in-line four-cylinder engine. As illustrated in FIGS. 1–3, the intake arrangement includes intake manifold 1 having intake collector 2 and four branch pipes 4A, 4B, 4C and 4D. Intake manifold 1 is made of a suitable resin material. Intake collector 2 is elongated along a direction of a row of four engine cylinders #1–#4 of engine 8 as shown in FIG. 4A. Four branch pipes 4A, 4B, 4C and 4D are connected at one end thereof to corresponding four engine cylinders #1, #2, #3 and #4, and connected at opposite end thereof to intake collector 2, respectively. Intake pipe 3 is coupled to an end wall of intake collector 2 which extends substantially perpendicular to a longitudinal direction of intake collector 2. The end wall of intake collector 2 is disposed on a left side as viewed in FIG. 1. Intake pipe 3 is adapted to introduce intake air into intake collector 2. The intake air introduced into intake collector 2 through intake pipe 3 is supplied to four engine cylinders #1–#4 via branch pipes 4A–4D.

Figure 4B:
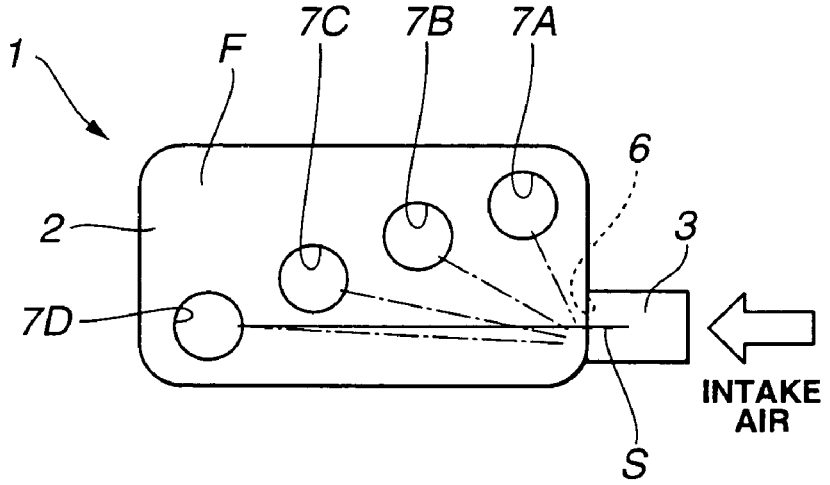

Specifically, as shown in FIGS. 4A and 4B, intake collector 2 has inlet opening 6 on the end wall of intake collector 2. Intake pipe 3 is connected to inlet opening 6 and introduces an intake air flow into intake collector 2 through inlet opening 6. Inlet opening 6 thus permits the intake air flow to be introduced into intake collector 2. As shown in FIG. 3, intake collector 2 is located above engine 8. The one end of each of branch pipes 4A–4D is connected to a side portion of engine 8. The ends of branch pipes 4A–4D are joined together via flange 5. Specifically, the one end of each of branch pipes 4A–4D is connected to an intake port of each of engine cylinders #1–#4 which is disposed in the side portion of engine 8. As seen from FIGS. 2 and 3, the opposite end of each of branch pipes 4A–4D is connected to one side wall F of intake collector 2. One side wall F extends in the longitudinal direction of intake collector 2, namely, in a direction substantially parallel to the intake air flow flowing through intake collector 2, and also along substantially an up-and-down or vertical direction of engine 8. Branch pipes 4A–4D extend in substantially same direction, namely, in a direction substantially perpendicular to the longitudinal direction of intake collector 2. Specifically, as shown in FIG. 3, branch pipes 4A–4D extend in the up-and-down direction of engine 8 and curve to form a generally U-shape. The opposite ends of branch pipes 4A–4D are connected to branch openings 7A, 7B, 7C and 7D formed in one side wall F of intake collector 2. Branch openings 7A–7D permit the intake air flow introduced into intake collector 2 to flow from intake collector 2 into branch pipes 4A–4D.

Referring to FIGS. 4A and 4B, there is shown a positional relation between inlet opening 6 located at the connection of intake collector 2 and intake pipe 3, and branch openings 7A–7D located at the connection of intake collector 2 and branch pipes 4A–4D.

FIG. 4A is a schematic plan view of the intake arrangement of this embodiment, showing intake collector 2, intake pipe 3 and branch pipes 4A–4D. As illustrated in FIG. 4A, branch openings 7A–7D of branch pipes 4A–4D are arranged in an equidistantly spaced relation to one another in the longitudinal direction of intake collector 2.

FIG. 4B is a schematic diagram showing an arrangement of inlet opening 6 and branch openings 7A–7D. Inlet opening 6 is disposed on a lower side of the longitudinal end surface of intake collector 2 as viewed in an up-and-down direction in FIG. 4B. Branch openings 7A–7D are formed in one side wall F of intake collector 2. Specifically, branch openings 7A–7D are arranged such that as a distance from inlet opening 6 thereto along the longitudinal direction of intake collector 2 decreases, an amount of offset thereof from reference streamline S of the intake air flow introduced from inlet opening 6 increases. Reference streamline S of the intake air flow means a main streamline of the intake air flow which extends through substantially a center of inlet opening 6 along the longitudinal direction of intake collector 2. Namely, branch openings 7A–7D are arranged such that as the distance between inlet opening 6 and branch openings 7A–7D decreases, the position of branch openings 7A–7D is more offset from reference streamline S of the intake air flow. Branch openings 7A–7D are arranged in a row along an imaginary straight line inclined relative to the reference streamline S of the intake air flow. In FIG. 4B, branch opening 7A is closest to inlet opening 6 and most offset and farthest spaced from reference streamline S of the intake air flow. On the other hand, branch opening 7D is most distant from inlet opening 6 and substantially placed on reference streamline S of the intake air flow. In other words, branch openings 7A–7D are arranged offset from one another in the up-and-down direction in FIG. 4B such that as the distance between inlet opening 6 and branch openings 7A–7D decreases, the position of branch openings 7A–7D is displaced more upwardly. With the arrangement of inlet opening 6 and branch openings 7A–7D, a difference between the distances from inlet opening 6 to respective branch openings 7A–7D can be decreased. Therefore, a difference between substantial lengths of the intake air passages extending from inlet opening 6 to respective branch openings 7A–7D can be reduced. This serves for equalizing the substantial lengths of the intake air passages.

Further, the intake air flow flowing from inlet opening 6 into branch opening 7A disposed closest to inlet opening 6 is most diverted upwardly as viewed in FIG. 4B, to thereby cause increased flow resistance in branch pipe 4A connected to branch opening 7A as compared to flow resistance in branch pipes 4B–4D connected to branch openings 7B–7D. Namely, branch opening 7A disposed nearest to one end of intake collector 2 is located closest to inlet opening 6, and the flow resistance in branch pipe 4A connected to branch opening 7A is relatively large. In contrast, branch opening 7D disposed nearest to the other end of intake collector 2 is located most distantly from inlet opening 6, and the flow resistance in branch pipe 4D connected to branch opening 7D is relatively small. Owing to this arrangement, induction noise, namely, sound pressure, caused in the intake arrangement due to the difference between the substantial intake air passage lengths can be effectively reduced.

Figure 5:
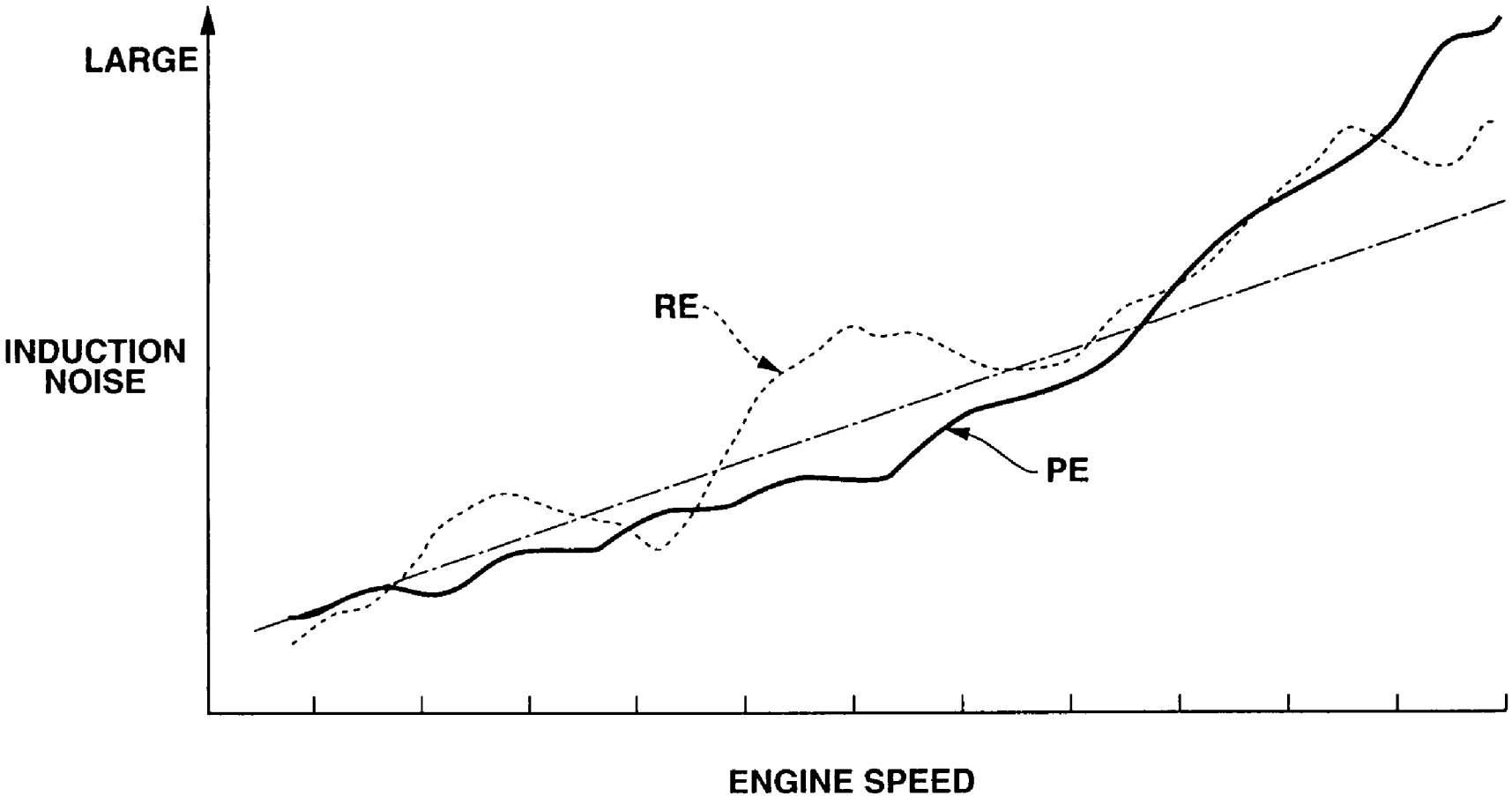
FIG. 5 is an explanatory diagram illustrating characteristics of induction noises that are generated in the intake arrangement according to the present invention and an intake arrangement of a conventional art.
Figure 6A:
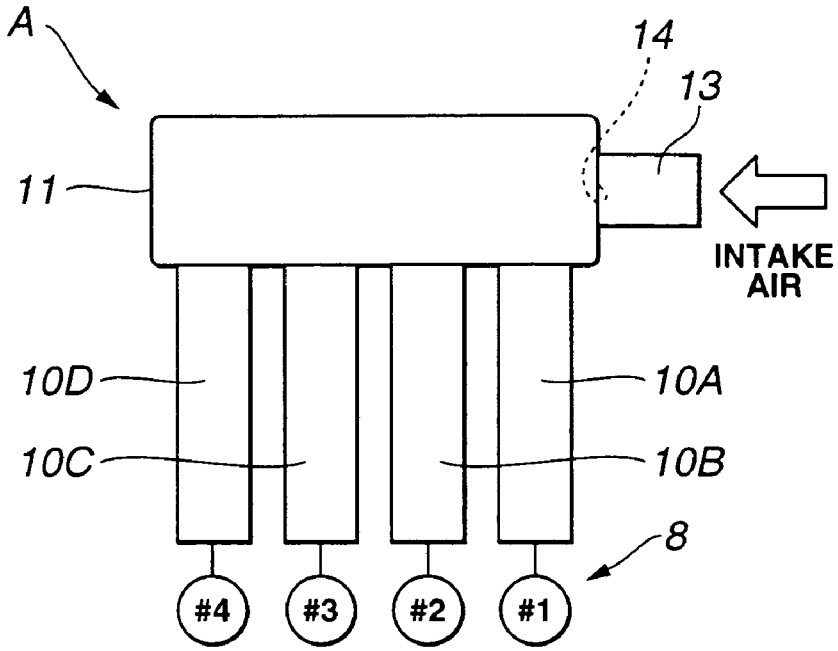
FIGS. 6A–6B are explanatory diagrams illustrating an intake arrangement of a first comparative example.
Figure 6B:
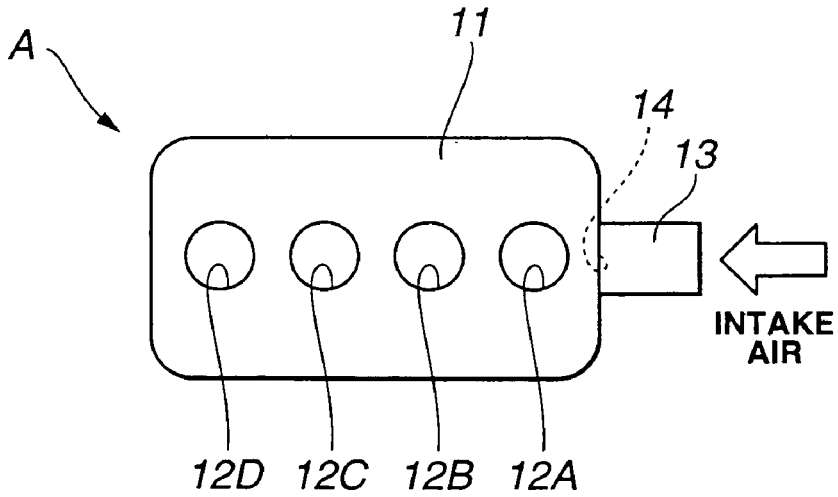

FIG. 5 shows results of measurement of the induction noise caused in the intake arrangement of this embodiment and the induction noise caused in an intake arrangement of the first comparative example as shown in FIGS. 6A and 6B. In FIG. 5, solid line PE indicates the measurement results of the intake arrangement of this embodiment, and dotted line RE indicates the measurement results of the intake arrangement of a first comparative example. As seen from FIG. 5, the intake arrangement of this embodiment can exhibit the effect of reducing the induction noise. Further, in the intake arrangement of this embodiment, as engine speed increases, sound pressure becomes large. This can prevent hunching of the induction noise which is caused due to change in the engine speed, and therefore, can serve for preventing a vehicle driver suffering from having unusual feeling.

Referring to FIGS. 6A and 6B, the intake arrangement of the first comparative example is explained, which differs in the positional relation between the inlet opening located at the connection of the intake collector and the intake pipe, and the branch openings located at the connection of the intake collector and the branch pipes, from the above-described first embodiment of the present invention. As illustrated in FIG. 6A, the intake arrangement of the first comparative example includes intake pipe 13 and intake manifold A including intake collector 11 and four branch pipes 10A–10D. Intake pipe 13 are connected to inlet opening 14 of a longitudinal end surface of intake collector 11. Four branch pipes 10A–10D are connected to branch openings 12A–12D formed in a side wall of intake collector 11 as illustrated in FIG. 6B. Branch openings 12A–12D are arranged in a row in the longitudinal direction of intake collector 11 without being offset from one another in the up-and-down direction as viewed in FIG. 6B, namely, in a direction perpendicular to the longitudinal direction of intake collector 11. In this arrangement, a difference between a distance from inlet opening 14 to branch opening 12A and a distance from inlet opening 14 to branch opening 12D is increased as compared to the first embodiment shown in FIG. 4B. Accordingly, a difference between the substantial intake air passage lengths extending from inlet opening 14 to engine cylinders #1–#4 through branch pipes 10A–10D becomes larger than the difference between the intake air passage lengths extending from inlet opening 6 to engine cylinders #1–#4 through branch pipes 4A–4D in the first embodiment. Further, as seen from FIG. 5, induction noise RE caused in the intake arrangement of the first comparative example significantly fluctuates relative to engine speed. In contrast, induction noise PE caused in the intake arrangement of the first embodiment increases without significant fluctuation, as engine speed increases.

Figure 7:
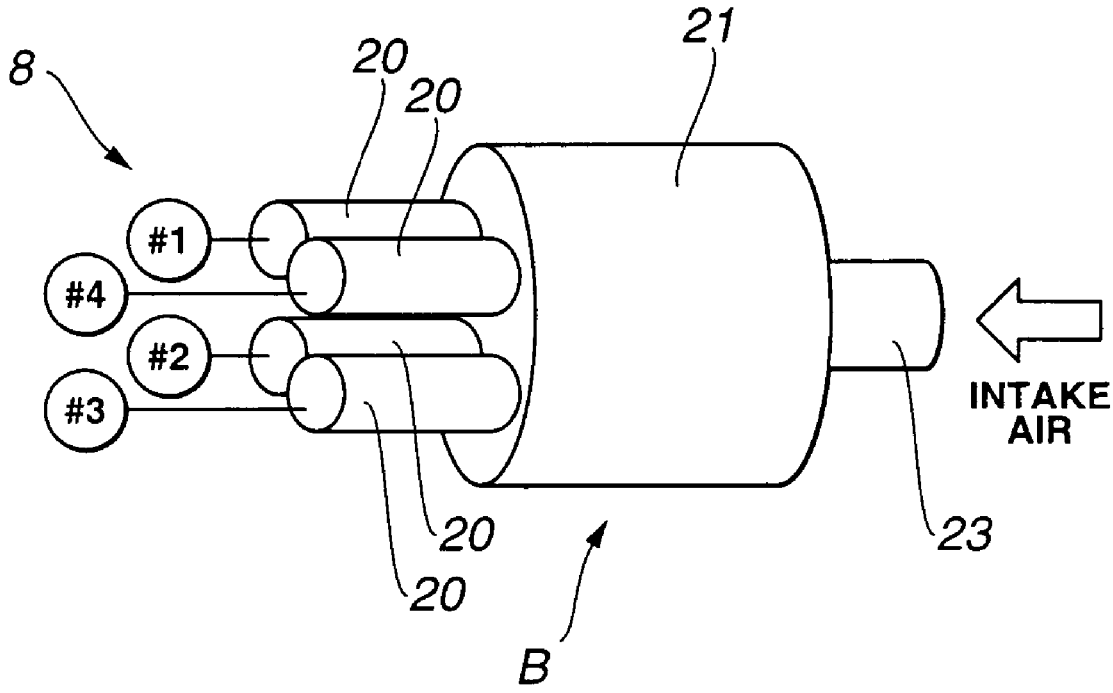
FIG. 7 is an explanatory diagram illustrating an intake arrangement of a second comparative example.

Referring to FIG. 7, there is shown the intake arrangement of a second comparative example. As illustrated in FIG. 7, the intake arrangement includes intake pipe 23 and intake manifold B including intake collector 21 and four branch pipes 20. Intake pipe 23 is connected to one end wall of intake collector 21 which extends in the longitudinal direction of intake collector 21, through an inlet opening formed in the one end wall thereof. Branch pipes 20 are connected to an opposite end wall of intake collector 21 through branch openings formed in the opposite end wall thereof. The branch openings are not arranged in a row as shown in FIG. 7. Branch pipes 20 extend substantially parallel to a direction of the intake air flow passing through intake collector 21. In the second comparative example, distances from the inlet opening to the branch openings are substantially equal to one another. The substantial intake air passage lengths extending from the inlet opening to respective engine cylinders #1–#4 through branch pipes 20 are substantially equal to one another. However, intake manifold B of the intake arrangement of the second comparative example is structurally complicated and cannot be produced by die forming. Since intake manifold B of the second comparative example is formed by a limited construction method, the productivity will be deteriorated and the cost and weight will be increased. Further, the intake arrangement of the second comparative example is large in size, whereby the installability to a vehicle will be deteriorated. In contrast, in the intake arrangement of the first embodiment, branch pipes 4A–4D connected to branch openings 7A–7D are arranged along the longitudinal direction of intake collector 2. Therefore, the intake arrangement of the first embodiment can be produced by die forming and can be prevented from being deteriorated in productivity.

Figure 8:
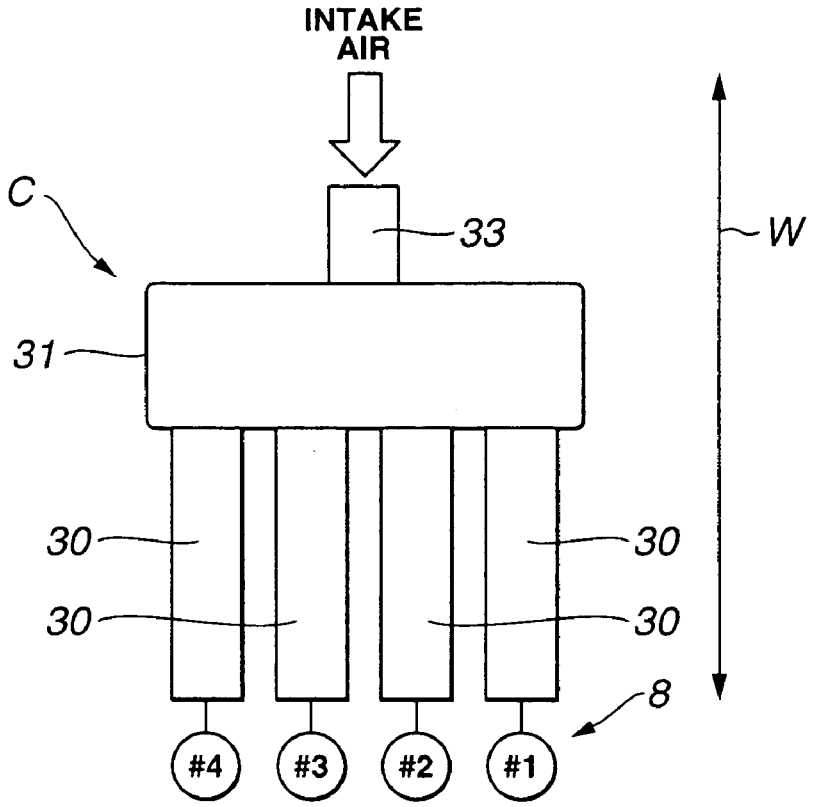
FIG. 8 is an explanatory diagram illustrating an intake arrangement of a third comparative example.

Referring to FIG. 8, there is shown the intake arrangement of a third comparative example. As illustrated in FIG. 8, the intake arrangement includes intake pipe 33 and intake manifold C including intake collector 31 and four branch pipes 30. Intake pipe 33 is connected to one side wall of intake collector 31 at a substantially middle position in the longitudinal direction of intake collector 31, through an inlet opening formed in the one side wall thereof. Branch pipes 30 are connected to an opposite side wall of intake collector 31 through branch openings formed in the opposite side wall thereof. In the intake arrangement of the third comparative example, a difference between the substantial intake air passage lengths is reduced, but a width of the intake arrangement which extends from intake pipe 33 to branch pipes 30 in direction W of FIG. 8, is increased. This causes deterioration in the installability to a vehicle. In contrast, the width of the intake arrangement of the first embodiment is reduced as compared to the width of the intake arrangement of the third comparative example.

Figure 9:
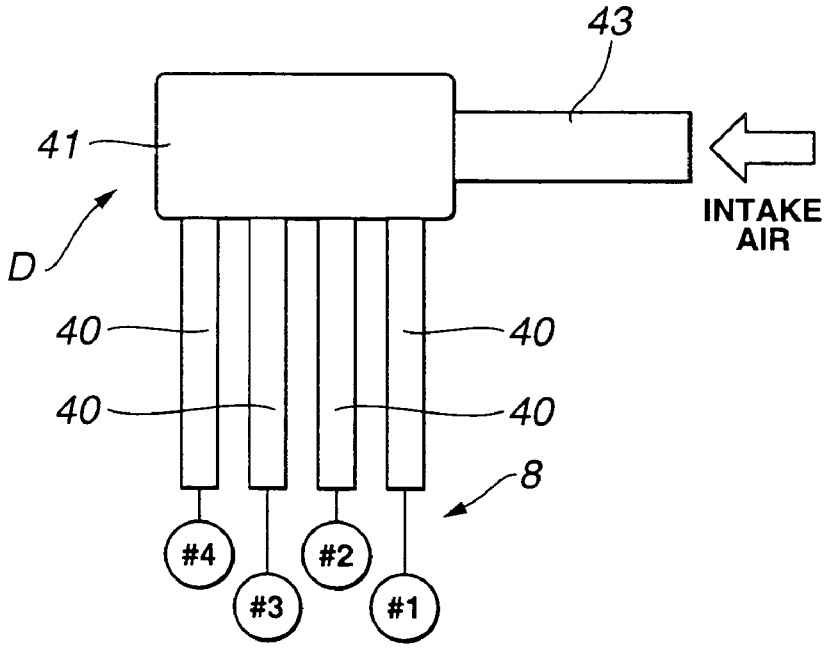
FIG. 9 is an explanatory diagram illustrating an intake arrangement of a fourth comparative example.

Referring to FIG. 9, there is shown the intake arrangement of a fourth comparative example. This intake arrangement is similar to the intake arrangement of the first comparative example shown in FIG. 6A except that intake collector 41 of intake manifold D has a reduced longitudinal length as compared to intake collector 11 of the first comparative example. Reference numeral 43 denotes an intake pipe connected to an end wall of intake collector 41 through an inlet opening formed in the end wall. Reference numeral 40 denotes four branch pipes connected to a side wall of intake collector 41 through branch openings formed in the side wall. In the fourth comparative example including intake collector 41 having the reduced longitudinal length, a difference between the substantial intake air passage lengths becomes smaller than that in the first comparative example. However, an opening area of the respective branch openings and a cross-sectional area of respective branch pipes 40 must be reduced or a shape of the branch openings must be deformed into an elliptic shape. This causes deterioration in an effect of intake air pulsation in branch pipes 40 and increase in flow resistance therein. In contrast, the intake arrangement of the first embodiment can be prevented from decreasing the opening area of branch openings 7A–7D and the cross-sectional area of branch pipes 4A–4D and from deforming the shape of branch openings 7A–7D. This can achieve a desired pulsation effect in branch pipes 4A–4D of the intake arrangement of the first embodiment.

Figure 10:
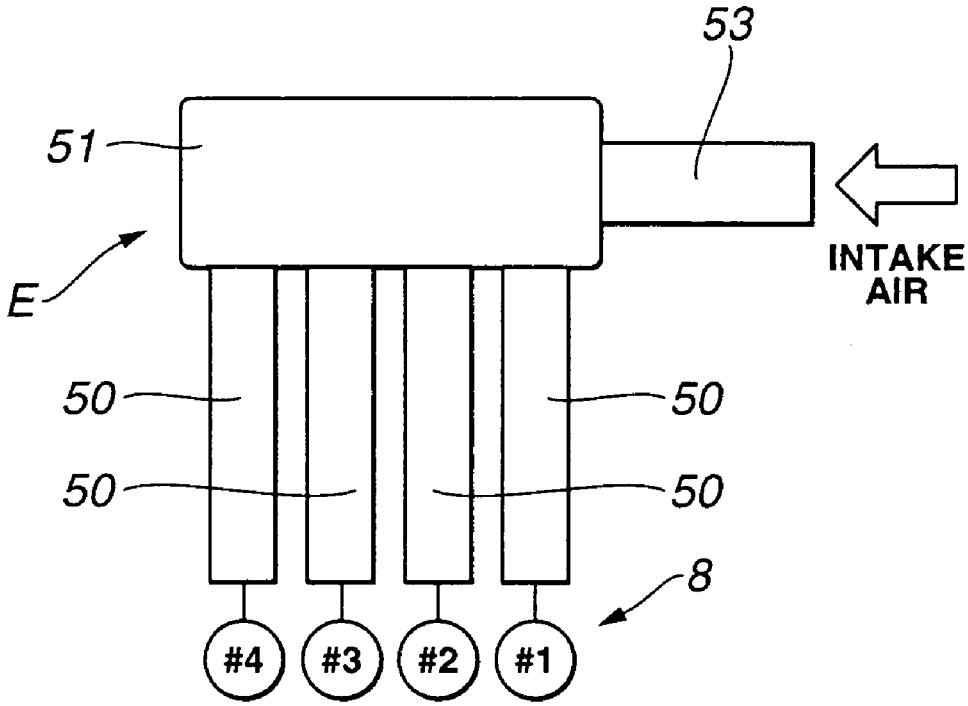
FIG. 10 is an explanatory diagram illustrating an intake arrangement of a fifth comparative example.

Referring to FIG. 10, there is shown the intake arrangement of a fifth comparative example. In this intake arrangement, the layout of intake pipe 53 and branch pipes 50 of intake manifold E is similar to that of intake pipe 13 and branch pipes 10A–10D of intake manifold A of the first comparative example, except that a distance between adjacent branch pipes 50 is reduced as compared to a distance between adjacent branch pipes 10A–10D. In the fifth comparative example, a difference between the substantial intake air passage lengths becomes smaller than that in the first comparative example, but freedom of design of a shape of branch openings to which branch pipes 50 are connected is restricted so that the branch openings cannot be formed into a bell-mouth shape. This causes deterioration in flow resistance in branch pipes 50. In contrast, branch openings 7A–7D of the intake arrangement of the first embodiment can be prevented from being restricted in freedom of design of the shape, whereby branch pipes 4A–4D can avoid deterioration in flow resistance.

Figure 11:
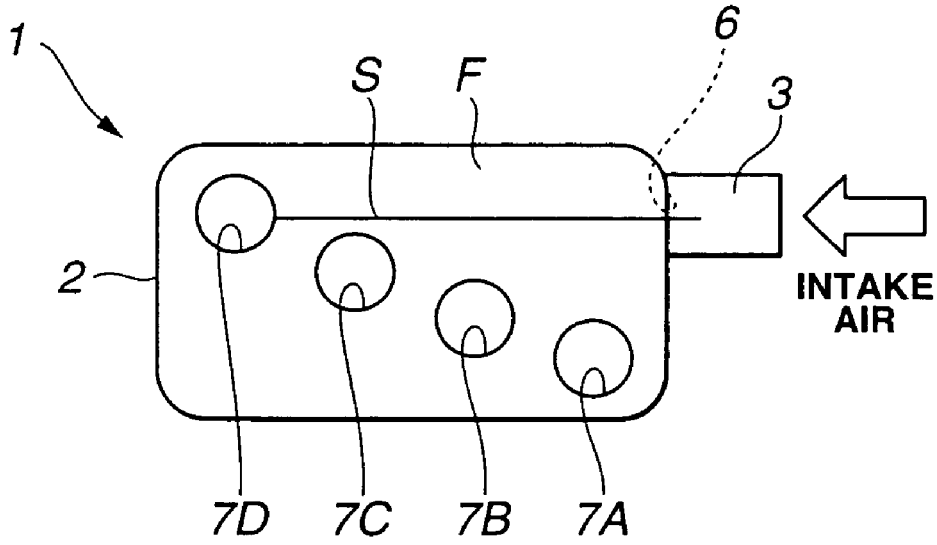
FIG. 11 is an explanatory diagram illustrating an intake arrangement of a second embodiment of the present invention.
Figure 12:
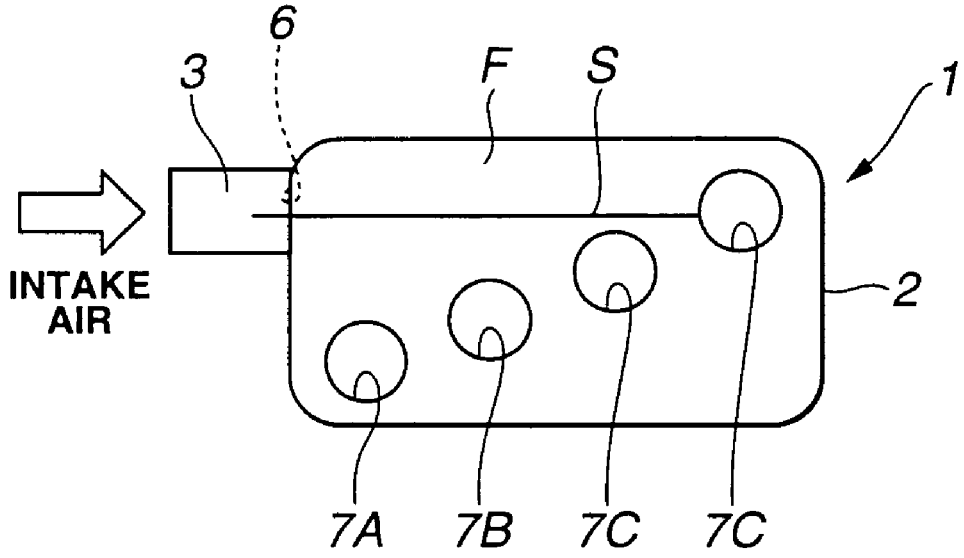
FIG. 12 is an explanatory diagram illustrating an intake arrangement of a third embodiment of the present invention.
Figure 13:
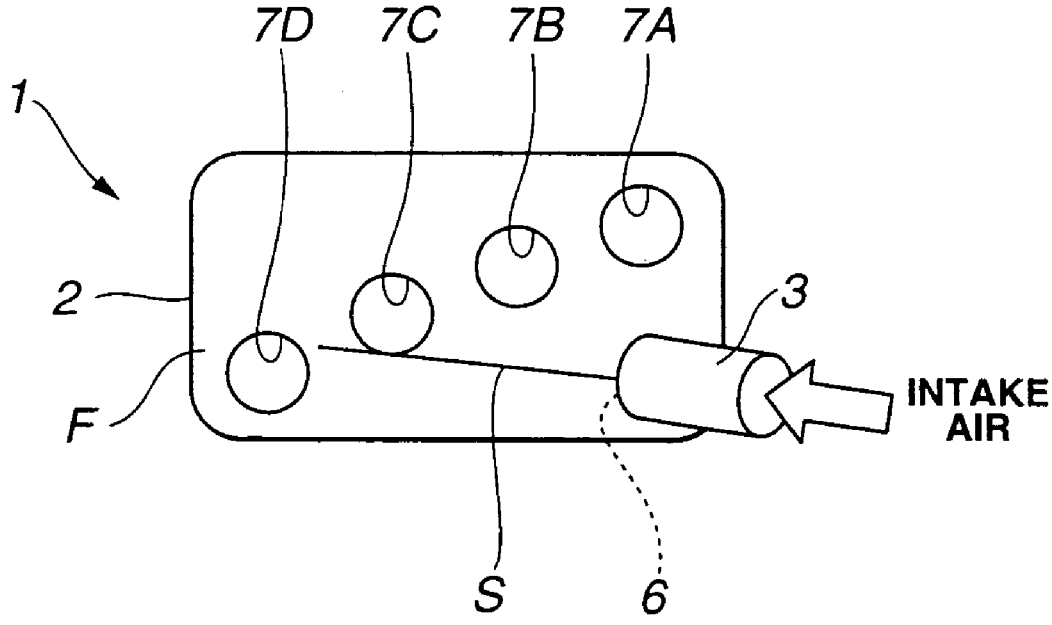
FIG. 13 is an explanatory diagram illustrating an intake arrangement of a fourth embodiment of the present invention.

Referring to FIGS. 11–13, second to fourth embodiments of the intake arrangement of the present invention will be explained hereinafter. FIGS. 11–13 illustrate diagrams similar to FIG. 4B of the first embodiment, but showing modifications of the arrangement of intake pipe 3 relative to intake collector 2. In FIGS. 11–13, there is shown the same offset arrangement of branch openings 7A–7D relative to reference streamline S as described in the first embodiment. As illustrated in FIG. 11, intake pipe 3 is connected to inlet opening 6 located on an upper portion of the end wall of intake collector 2. As illustrated in FIG. 11, intake pipe 3 is connected to inlet opening 6 formed on an end wall of intake collector 21 which is located on an opposite side of intake collector 21 shown in FIG. 4B. AS illustrated in FIG. 13, intake pipe 3 is connected to inlet opening 6 disposed on one side wall F of intake collector 21 near an end wall thereof. Intake pipe 3 is connected to one side wall F of intake collector 21 in an inclined state relative to a direction perpendicular to one side wall F.

Figure 16:
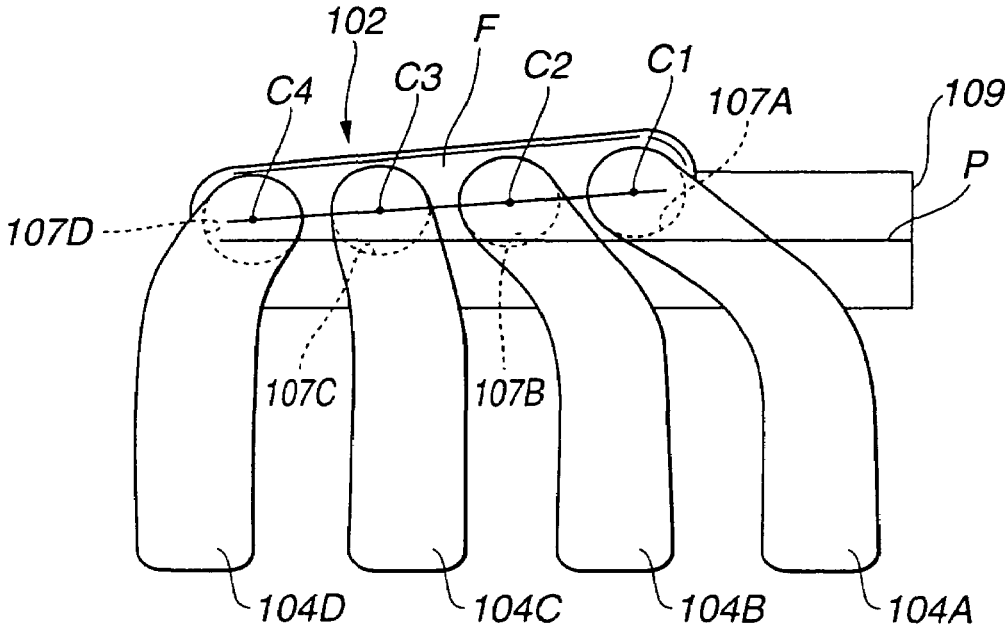
FIG. 16 is an explanatory diagram schematically illustrating the intake arrangement shown in FIG. 14.
Figure 17:
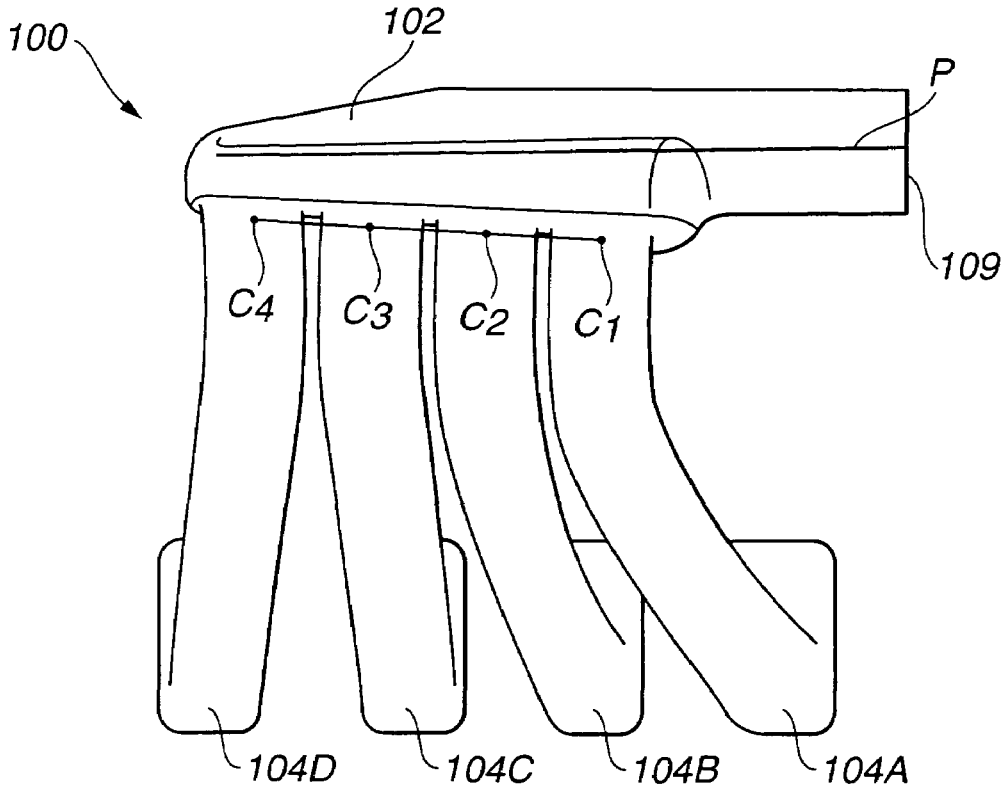
FIG. 17 is an explanatory diagram schematically illustrating the intake arrangement shown in FIG. 16.
Figure 18:
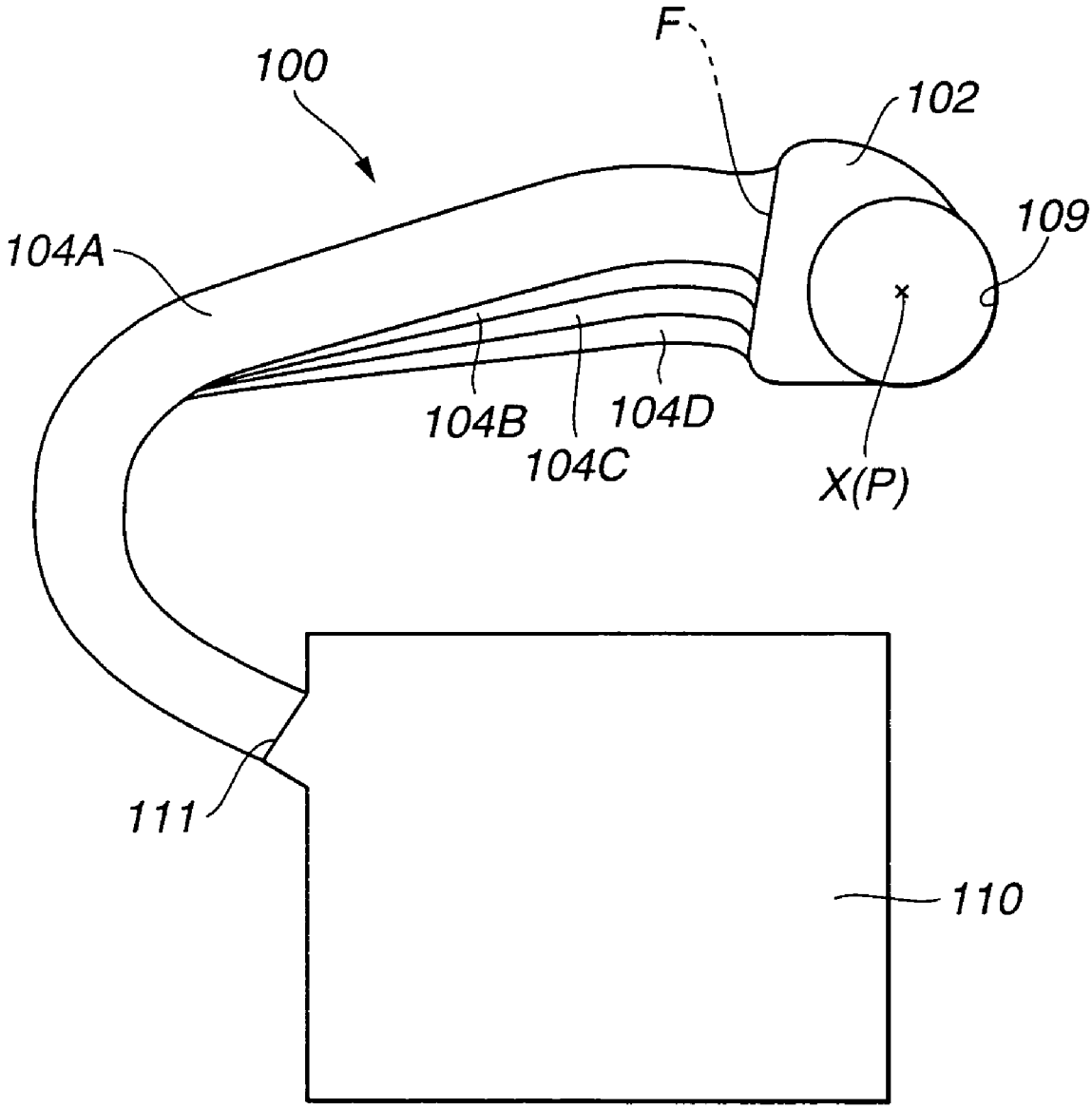
FIG. 18 is an explanatory diagram schematically illustrating a side view of the intake arrangement shown in FIG. 17 as viewed from a right side thereof.

Referring to FIGS. 14–18, a fifth embodiment of the intake arrangement of the present invention will be explained hereinafter. Similar to the first embodiment, the intake arrangement of the sixth embodiment is applied to an in-line four-cylinder engine. As illustrated in FIGS. 14–18, the intake arrangement includes intake manifold 100 having intake collector 102 and four branch pipes 104A, 104B, 104C and 104D. Intake manifold 100 is made of a suitable resin material. As shown in FIG. 18, intake collector 102 is disposed above engine 110. Intake collector 102 is elongated along a direction of a row of four engine cylinders of engine 110. Each of four branch pipes 104A, 104B, 104C and 104D has one end connected to intake port 111 of the corresponding engine cylinder.

Figure 14:
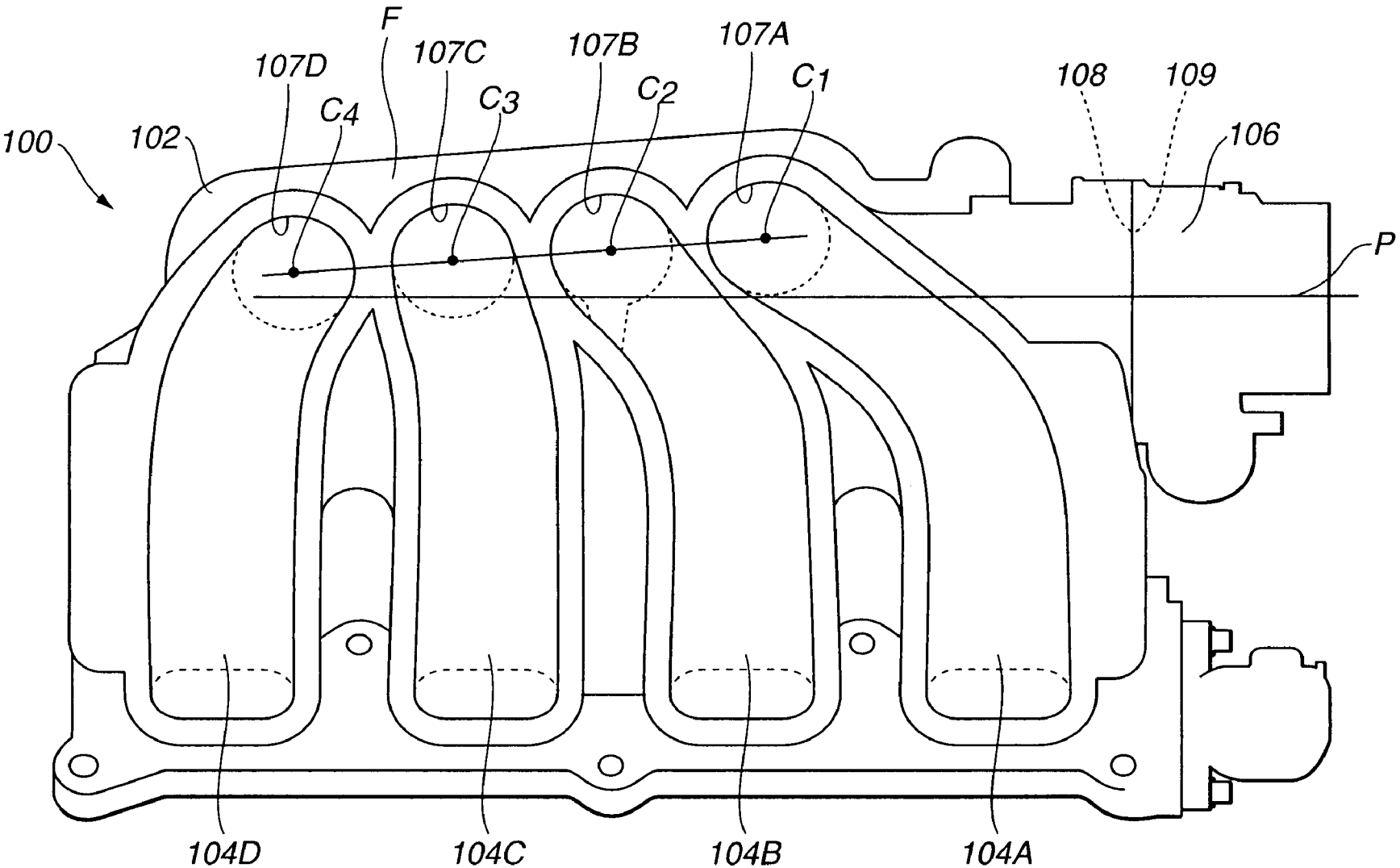
FIG. 14 is a cross section of an intake arrangement of a fifth embodiment of the present invention.
Figure 15:
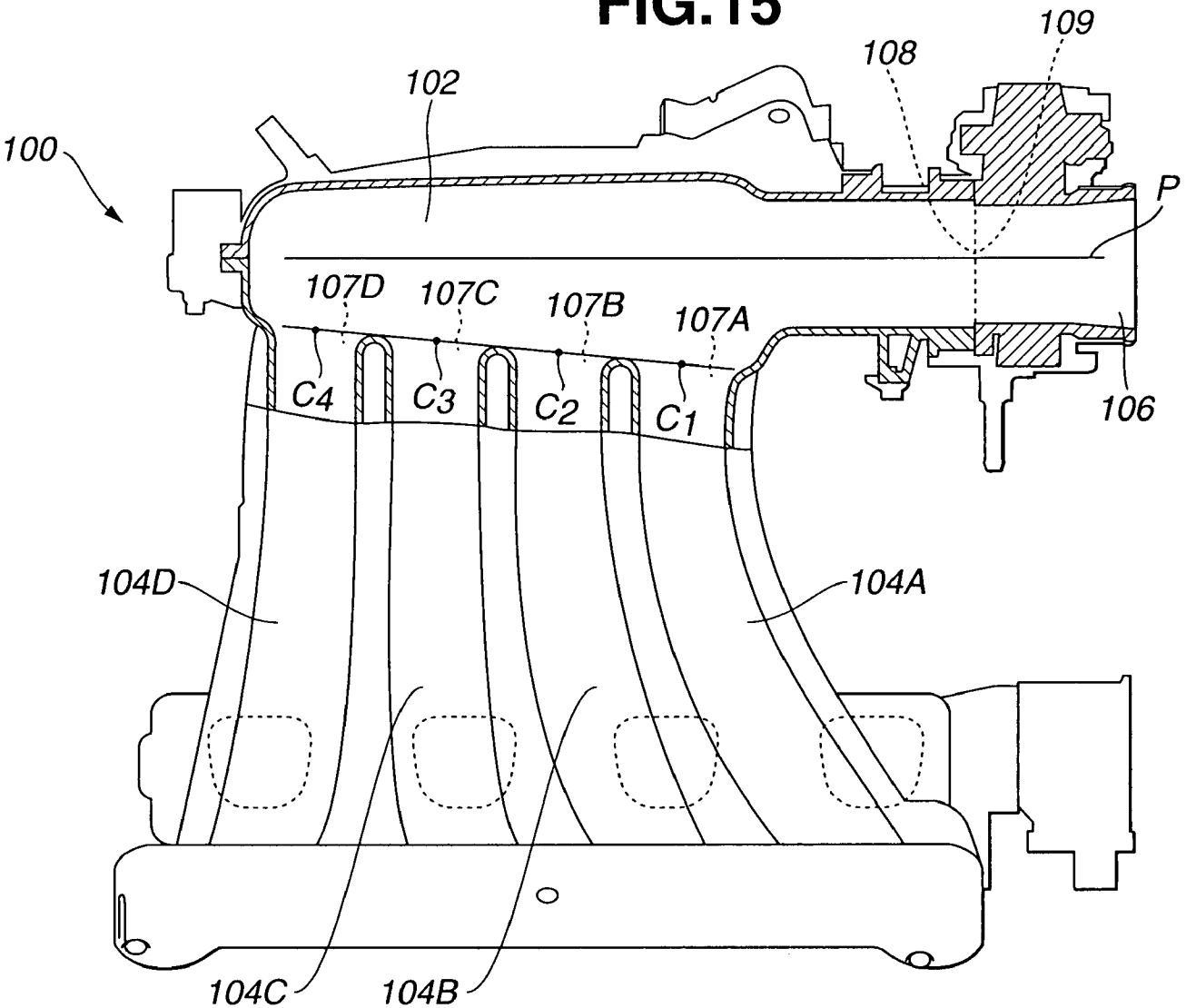
FIG. 15 is a cross section, taken along a plane perpendicular to the cross section shown in FIG. 14.

As shown in FIGS. 14 and 15, throttle chamber 106 is coupled to inlet opening 109 of intake collector 102. Inlet opening 109 is disposed at an end portion of intake collector 2 in the longitudinal direction. Throttle chamber 106 has central axis P and outlet 108 that is disposed adjacent to inlet opening 109 of intake collector 102. Throttle chamber 106 is arranged such that central axis P is in alignment with center X, shown in FIG. 18, of inlet opening 109 of intake collector 102. Central axis P of throttle chamber 106 extends through center X of inlet opening 109 of intake collector 102 along the longitudinal direction of intake collector 102, namely, in a direction of the intake air flow introduced into intake collector 102. Central axis P of throttle chamber 106, therefore, is in alignment with reference streamline of the intake air flow as explained in the first embodiment. Throttle chamber 106 accommodates a throttle valve, not shown, operative to regulate an intake air flow introduced into throttle chamber 106. The intake air flow in throttle chamber 106 is variably controlled depending on an opening degree of the throttle valve and introduced into intake collector 102. The intake air is then delivered to the engine cylinders via branch pipes 104A–104D.

Each of branch pipes 104A–104D has an opposite end connected to branch openings 107A, 107B, 107C and 107D formed in one side wall F of intake collector 102. As shown in FIG. 18, branch pipes 104A–104D extend in substantially same direction, namely, in an up-and-down or vertical direction of engine 8, and curve to form a generally U-shape. One side wall F of intake collector 102 extends substantially along the up-and-down direction of engine 110 as shown in FIG. 18, and also extends along the longitudinal direction of intake collector 102 as illustrated in FIG. 14.

FIGS. 14 and 15 illustrate a positional relation between inlet opening 109 of intake collector 102, branch openings 107A, 107B, 107C and 107D thereof, and central axis P of throttle chamber 106. FIG. 14 is a cross section of the intake arrangement of the fifth embodiment, taken along a plane substantially parallel to one side wall F of intake collector 102. As illustrated in FIG. 14, branch openings 107A, 107B, 107C and 107D formed in one side wall F of intake collector 102 have centers C1, C2, C3 and C4, respectively. Branch openings 107A–107D are arranged to establish a relation between centers C1–C4 thereof and central axis P of throttle chamber 106. The relation is that as a distance of branch openings 107A–107D from inlet opening 109 of intake collector 102 decreases, an amount of offset of centers C1–C4 from central axis P of throttle chamber 106 increases. In other words, as illustrated in FIG. 14, as the distance from inlet opening 109 of intake collector 102 to branch openings 107A–107D in the longitudinal direction of intake collector 102 decreases, the position of centers C1–C4 of branch openings 107A–107D is more offset upwardly from central axis P of throttle chamber 106. Specifically, as illustrated in FIGS. 14 and 16, centers C1–C4 of branch openings 107A–107D are offset upwardly from central axis P of throttle chamber 106. Centers C1–C4 of branch openings 107A–107D are substantially placed in a single straight line inclined relative to central axis P of throttle chamber 106.

FIG. 15 is a cross section of the intake arrangement of the fifth embodiment, taken along a plane perpendicular to the cross section shown in FIG. 14. As illustrated in FIG. 15, branch openings 107A–107D are arranged such that as a distance thereof from inlet opening 109 of intake collector 102 decreases, an amount of offset of centers C1–C4 of branch openings 107A–107D from central axis P of throttle chamber 106 increases. Specifically, as shown in FIGS. 15 and 17, centers C1–C4 of branch openings 107A–107D are offset downwardly from central axis P of throttle chamber 106. In other words, as the distance from inlet opening 109 of intake collector 102 to branch openings 107A–107D in the longitudinal direction of intake collector 102 decreases, the position of centers C1–C4 of branch openings 107A–107D is more offset downwardly from central axis P of throttle chamber 106. Centers C1–C4 of branch openings 107A–107D are substantially placed in a single straight line inclined relative to central axis P of throttle chamber 106. In this embodiment, centers C1–C4 of branch openings 107A–107D are placed in the straight lines inclined relative to central axis P of throttle chamber 106 as shown in FIGS. 14 and 15.

As explained above, in the intake arrangement of the fifth embodiment, as the position of branch openings 107A–107D is closer to inlet opening 109 of throttle chamber 106 in the longitudinal direction of intake collector 102, the position of centers C1–C4 of branch openings 107A–107D is more offset from central axis P of throttle chamber 106 in both of the cross sections shown in FIGS. 14 and 15. Accordingly, as the position of branch openings 107A–107D is closer to throttle chamber 106 in the longitudinal direction of intake collector 102, the offset amount of centers C1–C4 of branch openings 107A–107D from central axis P of throttle chamber 106 increases. With this arrangement, a difference between distances from inlet opening 109 of throttle chamber 106 to respective branch openings 107A–107D can be reduced. This serves for equalizing substantial intake air passages extending from throttle chamber 106 to intake ports 111 of the respective engine cylinders, to thereby reduce induction noise caused therein.

The above-explained relation between centers C1–C4 of branch openings 107A–107D and central axis P of throttle chamber 106 may be established in at least one of the cross sections shown in FIGS. 14 and 15. In such a case, the difference between the substantial intake air passages can be reduced so that the effect of reducing induction noise can be obtained. Further, centers C1–C4 of branch openings 107A–107D may be displaced from the straight lines inclined relative to central axis P as shown in FIGS. 14 and 15, without changing the relation to central axis P of throttle chamber 106.

The intake arrangements of the first through fifth embodiments of the present invention are applicable to not only the in-line four-cylinder engine but also a multi-cylinder engine including at least one cylinder group constituted of a plurality of engine cylinders, in which an intake collector is provided per cylinder group, and branch pipes connected to the intake collector are equal in number to the engine cylinders. For instance, the multi-cylinder engine includes a 4-multiple cylinder engine having engine cylinders of multiples of four such as eight, twelve . . . , a 3-multiple cylinder engine having engine cylinders of multiples of three such as three, six, nine . . . , and a 5-multiple cylinder engine having engine cylinders of multiples of five such as five, ten . . . . In a case where the intake arrangement of the present invention is applied to the 3-multiple cylinder engine and the 5-multiple cylinder engine, the effect of reducing induction noise is attained smaller than the intake arrangement applied to the 4-multiple cylinder engine, but the effect thereof is enhanced as compared to the intake arrangement of the first comparative example.

This application is based on prior Japanese Patent Applications Nos. 2003-351584 and 2003-351585 filed on Oct. 10, 2003. The entire contents of the respective Japanese Patent Applications Nos. 2003-351584 and 2003-351585 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An intake arrangement for an internal combustion engine, comprising:

an intake manifold including an intake collector and a plurality of branch pipes connected with the intake collector, the intake collector including an inlet opening through which an intake air flow is introduced into the intake collector, and a plurality of branch openings, the plurality of branch pipes being connected to the branch openings of the intake collector, the plurality of branch pipes extending in substantially same direction, the plurality of branch openings being arranged along a longitudinal direction of the intake collector such that as a distance thereof from the inlet opening decreases, an amount of offset thereof from a reference streamline of the intake air flow extending through substantially a center of the inlet opening along the longitudinal direction of the intake collector increases.

2. The intake arrangement as claimed in claim 1, wherein the intake collector includes an end wall extending in a direction perpendicular to the longitudinal direction of the intake collector, the inlet opening being formed in the end wall of the intake collector.

3. The intake arrangement as claimed in claim 1, wherein the intake collector includes a side wall extending in the longitudinal direction of the intake collector, the inlet opening being formed in the side wall of the intake collector near the end wall thereof.

4. The intake arrangement as claimed in claim 1, wherein the intake collector includes a side wall extending substantially parallel to the intake air flow.

5. The intake arrangement as claimed in claim 1, further comprising an intake pipe connected to the inlet opening of the intake collector.

6. The intake arrangement as claimed in claim 1, wherein the intake arrangement is adapted for the engine including at least one cylinder group constituted of a plurality of engine cylinders, the intake collector being provided per cylinder group, the branch pipes connected with the intake collector provided per cylinder group being equal in number to the plurality of the engine cylinders.

7. The intake arrangement as claimed in claim 6, wherein the plurality of engine cylinders constituting the cylinder group comprises four engine cylinders.

8. The intake arrangement as claimed in claim 6, wherein the plurality of engine cylinders constituting the cylinder group comprises three engine cylinders.

9. The intake arrangement as claimed in claim 2, wherein the inlet opening is located upward in the end wall of the intake collector in a vertical direction of the engine.

10. The intake arrangement as claimed in claim 1, wherein the branch openings are arranged along a straight line inclined relative to the reference streamline of the intake air flow.

11. The intake arrangement as claimed in claim 1, wherein the substantially same direction in which the branch pipes extend is a direction substantially perpendicular to the longitudinal direction of the intake collector.

12. The intake arrangement as claimed in claim 3, further comprising an intake pipe connected to the inlet opening of the intake collector, the intake pipe being connected in an inclined state relative to a direction perpendicular to the side wall of the intake collector.

13. The intake arrangement as claimed in claim 1, further comprising a throttle chamber connected to the inlet opening of the intake collector, the throttle chamber having a central axis extending along the longitudinal direction of the intake collector, the branch openings being formed in a side wall of the intake collector which extends along the longitudinal direction of the intake collector, the branch openings being arranged to establish a relation between centers of the branch openings and the central axis of the throttle chamber, the relation being that as a distance of the branch openings from the inlet opening decreases, an amount of offset of the centers of the branch openings from the central axis of the throttle chamber increases.

14. The intake arrangement as claimed in claim 13, wherein the centers of the branch openings are substantially placed in a straight line inclined relative to the central axis of the throttle chamber.

15. The intake arrangement as claimed in claim 13, wherein the relation between the centers of the branch openings and the central axis of the throttle chamber exists in at least one of a first cross section taken along a plane substantially parallel to the side wall of the intake collector and a second cross section taken along a plane perpendicular to the first cross section.

16. The intake arrangement as claimed in claim 13, wherein the center of the inlet opening is aligned with the central axis of the throttle chamber.

17. An intake arrangement for an internal combustion engine, comprising:

an intake collector;

a plurality of branch pipes;

first means for permitting an intake air flow to be introduced into the intake collector; and second means for permitting the intake air flow introduced into the intake collector to flow from the intake collector into the plurality of branch pipes, the second means being arranged along a longitudinal direction of the intake collector such that as a distance thereof from the first means decreases, an amount of offset thereof from a reference streamline of the intake air flow extending through substantially a center of the first means along the longitudinal direction of the intake collector increases.

18. The intake arrangement as claimed in claim 17, wherein the second means are arranged along a straight line inclined relative to the reference streamline of the intake air flow.

19. The intake arrangement as claimed in claim 17, further comprising an intake pipe connected to the first means.

20. The intake arrangement as claimed in claim 17, further comprising a throttle chamber connected to the first means.

* * * * *